US010385679B2

(12) United States Patent
Wang et al.

(10) Patent No.: US 10,385,679 B2
(45) Date of Patent: Aug. 20, 2019

(54) PRESSURE MONITORING

(71) Applicant: General Electric Company, Schenectady, NY (US)

(72) Inventors: Dag Thorstein Wang, Oslo (NO); Bjorn Erik Seeberg, Oslo (NO); Christopher Grinde, Blommenholm (NO)

(73) Assignee: General Electric Company, Schenectady, NY (US)

( * ) Notice: Subject to any disclaimer, the term of this patent is extended or adjusted under 35 U.S.C. 154(b) by 750 days.

(21) Appl. No.: 15/046,493

(22) Filed: Feb. 18, 2016

(65) Prior Publication Data

US 2016/0281460 A1 Sep. 29, 2016

Related U.S. Application Data

(60) Provisional application No. 62/139,187, filed on Mar. 27, 2015.

(51) Int. Cl.
*E21B 47/06* (2012.01)
*E21B 41/00* (2006.01)

(52) U.S. Cl.
CPC ..... *E21B 47/06* (2013.01); *E21B 41/0007* (2013.01)

(58) Field of Classification Search
CPC ..... E21B 47/06; E21B 47/0007
USPC ..... 166/250.01
See application file for complete search history.

(56) References Cited

U.S. PATENT DOCUMENTS

| | | | | |
|---|---|---|---|---|
| 4,274,283 | A | 6/1981 | Maus et al. | |
| 5,622,223 | A | 4/1997 | Vasquez | |
| 5,957,199 | A | 9/1999 | McLean et al. | |
| 2006/0195263 | A1 | 8/2006 | Meinig et al. | |
| 2010/0198547 | A1* | 8/2010 | Mulligan | E21B 41/0007 702/100 |
| 2014/0060175 | A1* | 3/2014 | Hutchings | G01F 7/00 73/196 |

OTHER PUBLICATIONS

International Search Report and Written Opinion issued in connection with corresponding Application No. PCT/US2016/023916 dated Jun. 29, 2016.

* cited by examiner

*Primary Examiner* — Anna M Momper
*Assistant Examiner* — Patrick F Lambe
(74) *Attorney, Agent, or Firm* — Mintz Levin Cohn Ferris Glovsky and Popeo, P.C.

(57) ABSTRACT

A system and associated method for monitoring pressure of water at a sub-surface water location. The system includes a chamber, enclosing a fluid, and a fluid line. The system includes a differential pressure sensor with first and second fluid pressure inputs connected to the chamber and the fluid line, respectively. The system includes a first valve configured to have a first position in which the chamber is in fluid communication with the fluid line through the first valve and configured to have a second position in which the chamber is blocked from fluid communication with the line. The system includes a second valve configured to have a first position in which the fluid line is blocked from fluid communication with the water at the sub-surface location and is configured to have a second position in which the line is in fluid communication with the water through the second valve.

19 Claims, 4 Drawing Sheets

PRESSURE MONITORING

RELATED APPLICATION

The present application is a non-provisional application and claims benefit of priority from U.S. Provisional Patent Application No. 62/139,187, which is incorporated herein by reference.

BACKGROUND

During extraction or injection of petroleum oil, natural gas or other fluids into/from subsea reservoirs, there is a possibility of subsidence or elevation of the seabed floor. Monitoring for such motions is desirable both from a production optimization perspective and also from a safety and environmental perspective. Often, relevant water depths are in the range of hundred to several thousand of meters. Measuring minute dimension changes for such depth distances, with sufficient accuracy using remote techniques, is typically considered difficult. Furthermore, since the extent of the reservoirs of oil, natural gas or other fluids can be very extensive in size, multiple measurement location points may be required. The distance between these location points can be considerably large.

One technique that has been used to obtain such minute dimension changes is to employ a remotely operated underwater vehicle (ROV) with recently adjusted and calibrated pressure sensors measuring the water depth at concrete blocks placed on the seabed within an interval for which the sensor drift can be considered negligible. Use of an ROV becomes very expensive as the ROV has to transport a sensor between measurement location points, which are fixed locations, within a short time. The shortness of time is to be sufficiently short to prevent/hinder significant drift in the sensor.

Another technique that has been used to obtain such minute dimension changes is to employ very stable and sensitive pressure sensors placed on the seabed and post process their data. Since the measurement location points may extend beyond the extent of the subsea structures, it is considered expensive to operate these pressure sensors using wired connections. Permanently installed units are thus battery operated and typical communicate using sonic communication.

An additional challenge with using pressure sensors for level monitoring at elevated pressures is that the sensor elements typically need an extended period at elevated pressures before reaching stable performance. These periods have been observed to extend beyond 70 days.

Thus there is a need for continued improvements concerning improved resolution for monitoring small changes from a sampled pressure (e.g., associated with subsea movement such as subsidence).

BRIEF DESCRIPTION OF THE DISCLOSED SUBJECT MATTER

The following brief description presents a simplified summary in order to provide a basic understanding of some aspects of the system and/or method discussed herein. This brief description is not an extensive overview of the system and/or method discussed herein. It is not intended to identify key/critical elements or to delineate the scope of such system and/or method. Its sole purpose is to present some concepts in a simplified form as a prelude to the more detailed description that is presented later.

In accordance with one aspect, the disclosed subject matter provides a system for monitoring pressure of water at a sub-surface water environment location that has elevated water pressure. The system includes a chamber enclosing a fluid at pressure located therein. The system includes a differential pressure sensor, which includes a first fluid pressure input in fluid communication with the chamber and a second fluid pressure input. The system includes a fluid line in fluid communication with the second fluid pressure input of the differential pressure sensor. The system includes a first operable fluid control valve, which includes a first valve connection in fluid communication with the chamber and a second valve connection in fluid communication with the fluid line. The first fluid control valve is configured to have a first valve position in which the chamber is in fluid communication with the fluid line through the first fluid control valve and is configured to have a second valve position in which the chamber is blocked from fluid communication with the fluid line. The system includes a second operable fluid control valve, which including a first valve connection in fluid communication with the fluid line and a second valve connection in fluid communication with the water at the sub-surface water environment location. The second fluid control valve is configured to have a first valve position in which the fluid line is blocked from fluid communication with the water at the sub-surface water environment location and is configured to have a second valve position in which the fluid line is in fluid communication with the sub-surface water environment location through the second fluid control valve.

In accordance with another aspect, the disclosed subject matter provides a method for monitoring pressure of water at a sub-surface water environment location that has elevated water pressure using a system. The method includes providing a chamber enclosing a fluid located therein. The method includes providing a differential pressure sensor, including providing the differential pressure sensor to include a first fluid pressure input, in fluid communication with the chamber, and a second fluid pressure input. The method includes providing a fluid line in fluid communication with the second fluid pressure input of the differential pressure sensor. The method includes providing a first operable fluid control valve, including providing the first fluid control valve to include a first valve connection in fluid communication with the chamber and a second valve connection in fluid communication with the fluid line, and wherein the first fluid control valve being configured to have a first valve position in which the chamber is in fluid communication with the fluid line through the first fluid control valve and being configured to have a second valve position in which the chamber is blocked from fluid communication with the fluid line. The method includes providing a second operable fluid control valve, including providing the second fluid control valve to include a first valve connection in fluid communication with the fluid line and a second valve connection in fluid communication with the water at the sub-surface water environment location, and wherein the second fluid control valve being configured to have a first valve position in which the fluid line is blocked from fluid communication with the water at the sub-surface water environment location and being configured to have a second valve position in which the fluid line is in fluid communication with the water at the sub-surface water environment location through the second fluid control valve. The method includes placing the second fluid control valve in the respective first valve position to cause the fluid line to be blocked from fluid communication with the water at the sub-surface water environment location during placement of the system at the sub-surface water environment location. The method includes placing the first fluid control valve in the respective first valve position to cause the chamber to be in fluid communication with the fluid line through the first fluid control valve and placing the second fluid control valve in the respective second valve position to cause the fluid line to be in fluid communication with the water at the sub-surface water environment location through the second fluid control valve during sampling of pressure at the sub-surface water environment location to obtain a reference pressure. The method includes placing the first fluid control valve in the respective second valve position to cause the chamber to be blocked from fluid communication with the fluid line to capture the reference pressure in the chamber that is in fluid communication with the first fluid pressure input of the differential pressure sensor. The method includes using the differential pressure sensor to determine a difference between the reference pressure in the chamber and a pressure of water at the sub-surface water environment provided to the second fluid pressure input of the differential pressure sensor via the fluid line and the second fluid control valve being in the respective second valve position to cause the fluid line to be in fluid communication with the water at the sub-surface water environment location through the second fluid control valve.

BRIEF DESCRIPTION OF THE DRAWINGS

The foregoing and other aspects of the subject matter disclosed herein will become apparent to those skilled in the art to which the subject matter disclosed herein relates upon reading the following description with reference to the accompanying drawings, in which.

DETAILED DESCRIPTION OF THE DISCLOSED SUBJECT MATTER

Figure 1:
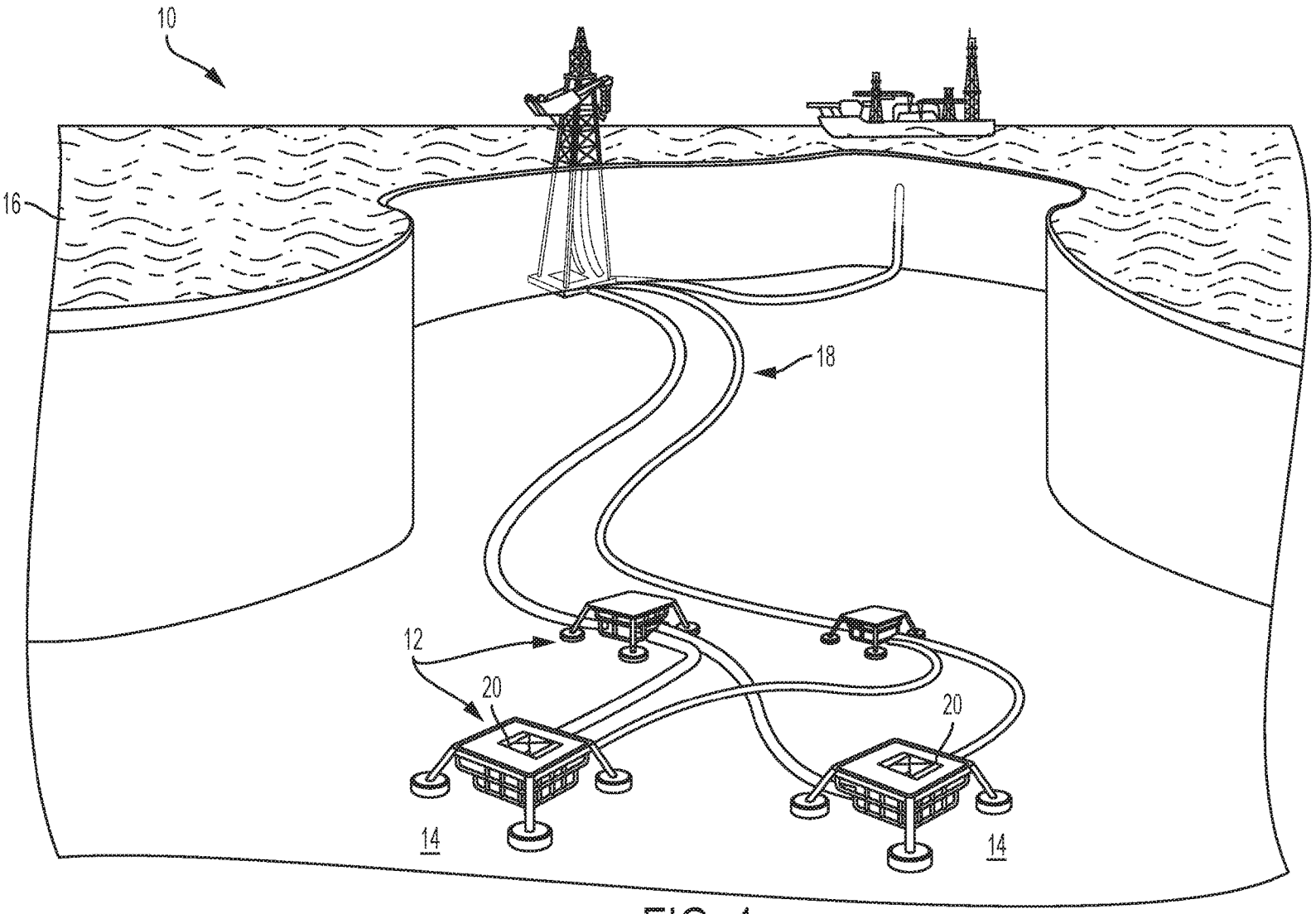
FIG. 1 is a schematic view of an example, sub-surface water setting, environment and an example fluid, such as natural gas/oil, handling arrangement within which one or more systems for sensing pressure in accordance at least one aspect of the subject matter disclosed herein may be present.

Example embodiments that incorporate one or more aspects of the subject matter disclosed herein are described and illustrated in the drawings. These illustrated examples are not intended to be a limitation on the subject matter disclosed herein. For example, one or more aspects of the subject matter disclosed herein can be utilized in other embodiments and even other types of devices.

In subsea arrangements, such as arrangements that handle natural gas/petroleum oil, there is a benefit to know subsea floor movement (e.g., subsidence) that causes change in water depth. Knowledge of subsea floor movement is useful because change in the subsea floor depth is associated change in water pressure at the subsea floor. In turn, change in water pressure can affect sensory equipment, etc.

When monitoring small changes to high pressures, such as at depth underwater, over an extended time period, sensor drift can become a useful performance parameter. Such a performance parameter may be of particular interest if the sensor is an absolute pressure sensor because sensor drift typically scales with measurement range of the sensor. In accordance with at least one aspect of the subject matter disclosed herein, a solution directed to the topic of sensor drift is provided. Specifically a differential pressure sensor and a reference, initial ambient pressure are used for monitoring to determine a change in pressure from the initial ambient.

FIG. 1 is a schematic illustration of an example water-setting environment 10 (e.g., saltwater or fresh water) and some example subsea arrangement(s) 12 that can employ one or more systems 20 in accordance with the subject matter disclosed herein. Each of the systems 20 is for monitoring pressure of water at a respective sub-surface water environment location 14 that has elevated water pressure due to depth in accordance with the subject matter disclosed herein. The subsea arrangement(s) 12 can be any subsea arrangement(s) below the water surface 16. Within one specific example, the subsea arrangement(s) 12 are associated with, or are a part of, a natural gas/oil handling arrangement 18. It is to be appreciated that the natural gas/oil handling arrangement 18 may involve, drilling, extraction, transportation, storage, etc. of natural gas/oil below the surface of the water 16 (e.g., possible at or below the subsea floor). It is to be appreciated that the natural gas/oil handling arrangement 18 may have many, different components, portions at several, different subsea locations. Of course, it is to be appreciated that although the natural gas/oil handling arrangement 18 is one example within which the system 20 for monitoring pressure of water at a sub-surface water environment location 14 that has elevated water pressure can be used, it is to be appreciated that the system 20 can be used in other arrangements (i.e., other than a natural gas/oil handling arrangement). Also, the water-setting environment, and the various terms associated therewith such as subsea, are to be understood to be for (e.g., encompass) salt water, brackish water and/or fresh water environments.

Figure 2:
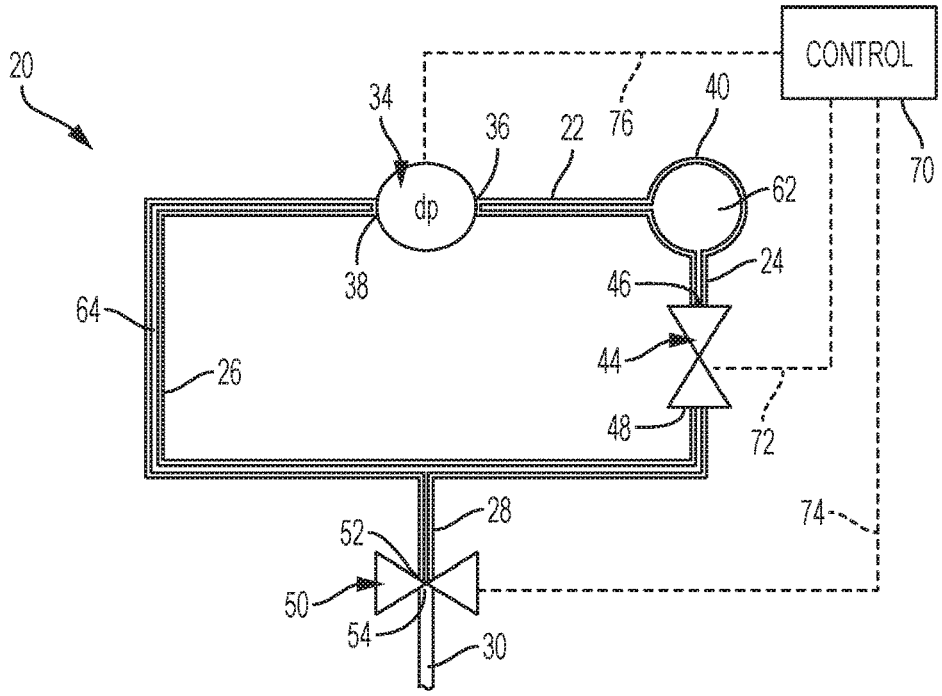
FIG. 2 is a schematic view of an example system in accordance with at least one aspect of the subject matter disclosed herein and shows the system in an initial state after assembly.

FIG. 2 is a schematic view of one example system 20 for monitoring pressure of water at a sub-surface/subsea water environment location that has elevated water pressure in accordance with at least one aspect of the present subject matter disclosed herein and shows the system 20 in an initial state after assembly. As mentioned, the example system 20 can be utilized within/part of the example subsea arrangements 12 shown within FIG. 1 or any other subsea arrangements. As can be appreciated, the example system 20 (FIG. 2) can include a series of hollow fluid line segments (e.g., tubing sections) 22-26. For reference the line segments 22-26 are designated first-third, respectively. The series of the first-third line segments 22-26 together form a general loop. Another, fourth line segment 28 can be connected to the third line segment 26 as a Tee or tail that has an outlet/inlet port 30 to water (e.g., seawater) at the Tee.

The example system 20 can also include a differential pressure (i.e., dp) sensor 34 with first and second fluid pressure inputs (e.g., input diaphragms or the like) 36, 38. Within the Figures, the dp sensor 34 and the first and second fluid pressure inputs 36, 38 are highly schematized. The dp sensor 34, and the first and second fluid pressure inputs 36, 38 thereof, can have any construction/configuration associated with a differential pressure sensor. Each of the first and second fluid pressure inputs 36, 38 of the dp sensor 34 is in fluid communication with a different line segment within the loop. Specifically, the first fluid pressure input 36 of the dp sensor 34 is in direct fluid connection/communication to the first line segment 22 and the second fluid pressure input 38 of the dp sensor 34 is in direct fluid connection/communication to the third line segment 26. The example system 20 can also include a hollow chamber or reservoir 40 in direct fluid communication, via the first fluid line segment 22, with the first fluid pressure input 36 of the dp sensor 34. The second fluid line segment 24 can be in fluid communication with the chamber 40. Within the shown example, the sequence of components can be: the first fluid pressure input 36 of the dp sensor 34, the first line segment 22, the chamber 40 and the second fluid line segment 24.

The example system 20 can include a first operable fluid control valve 44 (shown highly schematized within the Figures). The first fluid control valve 44 can include a first valve connection 46 in fluid communication the second fluid line segment 24. As such in the shown example, the first valve connection 46 of the first fluid control valve 44 can be in fluid communication with the chamber 40, via the second fluid line segment 24, and the first valve connection 46 is in fluid communication with the first fluid pressure input 36 of the dp sensor 34, via the second fluid line segment 24, the chamber 40 and the first fluid line segment 22.

The first fluid control valve 44 can include a second valve connection 48 in fluid communication with the third fluid line segment 26. As such in the shown example, the second valve connection 48 of the first fluid control valve 44 can be in fluid communication with the second fluid pressure input 38 of the dp sensor 34, via the third fluid line segment 26. Also, the second valve connection 48 of the first fluid control valve 44 can be in fluid communication with the Tee/fourth fluid line segment 28, via the third fluid line segment 26. The first fluid control valve 44 can be any type of fluid control valve that is operable to selectively: a) block fluid flow there through and b) permit fluid flow there through. The fluid flow can be a flow of water.

The example system 20 can include a second operable fluid control valve 50 (shown highly schematized within the Figures) located on the Tee/fourth fluid line segment 28. The second fluid control valve 50 can include a first valve connection 52 in fluid communication with the third fluid line segment 26, via the Tee/fourth fluid line segment 28. The second fluid control valve 50 can include a second valve connection 54 in fluid communication with the water at the sub-surface water environment location (e.g., 14 in FIG. 1), via the outlet/inlet port 30 (FIG. 2). The second fluid control valve 50 can be any type of fluid control valve that is operable to selectively: a) block fluid flow there through and b) permit fluid flow there through. The fluid flow can be a flow of water.

It is to be noted that the shown example can be oriented in FIGS. 2-6 with the Tee/fourth fluid line segment 28 directed downwardly from the loop defined by the first-third line segments 22-26. It is to be appreciated that the orientation may be different. For example, the Tee/fourth fluid line segment 28 could be directed upwardly or laterally with relation to the loop defined by the first-third line segments 22-26.

The first fluid control valve 44 can be configured to have an open valve position (e.g., see FIGS. 2 and 3) in which the second line segment 24 is in fluid communication with the third line segment 26 through the first fluid control valve 44. Accordingly, the open valve position (e.g., see FIGS. 2 and 3) of the first fluid control valve 44 is such that the third line segment 26 is in fluid communication with the chamber 40 and also the first fluid pressure input 36 of the dp sensor 34. Moreover, since the third line segment 26 is in direct fluid communication with the second fluid pressure input 38 of the dp sensor 34, the first and second fluid pressure inputs 36 and 38 of the dp sensor 34 can be in fluid communication with each other through the first fluid control valve 44, the chamber 40, etc. when the first fluid control valve 44 is in the open valve position. With portions/components in fluid communication, the fluid pressure is the same or common for the portions/components that are in fluid communication.

The first fluid control valve 44 can be configured to have a closed valve position (e.g., see FIGS. 5 and 6) in which fluid flow though the first fluid control valve 44 is blocked/prevented. So, with the first fluid control valve 44 in the closed valve position (e.g., see FIGS. 5 and 6), the chamber 40 and the first fluid pressure input 36 of the dp sensor 34 are blocked or isolated from fluid communication with the third line segment 26. As such, it is possible that the chamber 40 and the first fluid pressure input 36 of the dp sensor are associated with a pressure that is different from a pressure at the third line segment 26 when the first fluid control valve 44 is at the closed (e.g., blocking) valve position (e.g., see FIGS. 5 and 6). For ease of reference, the open valve position can be a first valve position and the closed valve position can be a second valve position. However, such nomenclature can be changed, omitted, etc.

The second fluid control valve 50 can be configured to have an open valve position (e.g., see FIGS. 4-6) in which the third line segment 26 is in fluid communication with the surrounding water (e.g., seawater). Accordingly, the open valve position (e.g., see FIGS. 4-6) of the second fluid control valve 50 is such that the second fluid pressure input 38 of the dp sensor 34 is at the pressure of the surrounding water (e.g., seawater).

The second fluid control valve 50 can be configured to have a closed valve position (e.g., see FIGS. 2 and 3) in which fluid flow though the second fluid control valve 50 is blocked/prevented. So, with the second fluid control valve 50 in the closed valve position (e.g., see FIGS. 2 and 3), the third line segment 26 and the second fluid pressure input 38 of the dp sensor 34 are blocked or isolated from fluid communication with the surrounding water (e.g., seawater). As such, it is possible that the third line segment 26 and the second fluid pressure input 38 of the dp sensor 34 are associated with a pressure that is different from a pressure at the surrounding water (e.g., seawater). For ease of reference, the closed valve position can be a first valve position and the open valve position can be a second valve position. However, such nomenclature can be changed, omitted, etc. It is to be appreciated that, with both of the first and second fluid control valves 44, 50 being in respective open positions (see FIG. 4), both of the first and second fluid pressure inputs 36, 38 of the dp sensor 34 are associated with the same pressure as the surrounding water (e.g., seawater).

It is to be appreciated that the operations of the first and second fluid control valves 44, 50 can be independent. As such, the first fluid control valve 44 can be in either its open or closed valve positions independent of the second fluid control valve 50 being in either its open or closed valve positions. Similarly, the second fluid control valve 50 can be in either its open or closed valve positions independent of the first fluid control valve 44 being in either its open or closed valve positions.

It is to be appreciated that with the ability of the second fluid control valve 50 being operated to be in the open position (e.g., See FIG. 4), at least some portions (e.g., the fourth and third line segments 28, 26) can receive the surrounding water (e.g., seawater). It is to be appreciated that with the ability of the first fluid control valve 44 to be operated to be in the open position (e.g., See FIG. 4), at least some further portions (e.g., the second and first line segments 24, 22, and the chamber 40) can receive the surrounding water (e.g., seawater), so long as the second fluid control valve 44 is also open.

For ease of reference, the fluid within the first and second line segments 22, 24, and the chamber 40 is referred to herein as a first fluid portion 62, and the fluid within the third line segment 26 is referred to herein as a second fluid portion 64. It is to be appreciated that the first and second fluid portions 62, 64 may be isolated from each other or in fluid communication/inter-mingled with each other, dependent upon the open/closed condition of the first fluid control valve 44. It is to be appreciated that the second fluid portion 64, and possibly the first fluid portion 62, may be isolated from the surrounding water (e.g., seawater) or in fluid communication/inter-mingled with the surrounding water, dependent upon the open/closed condition of the second fluid control valve 50 and the first fluid control valve 44.

Turning to the chamber 40, it is to be appreciated that the chamber is not limited to any specific size, shape, etc. The chamber 40 simply encloses a fluid (i.e., some of the first fluid portion 62), at any pressure, that is located therein. In one example, the chamber 40 can be as simple as another segment of line, similar to and interposed between the first and second line segments 22 and 24. So, "chamber" is to be broadly interpreted as structure to enclose a fluid. The fluid pressure may be provided via a fluid within the chamber 40 other than the surrounding water (e.g., seawater). For example, the fluid (e.g., part of first fluid portion 62) within the chamber 40 could include a gas as a fluid (with "fluid" being accorded a definition herein that is broad enough to encompass both liquid fluids and gaseous fluids). As another example, the fluid (e.g., part of the first fluid portion 62) within the chamber 40 could include a liquid (e.g., water other than the surrounding water/seawater). It is possible that such liquid in the chamber 40 may eventually have the surrounding water/seawater mixed therein via access though the second fluid control valve 50 and the first fluid control valve 44, sequentially. Recall that the chamber 40 is in fluid communication with the first fluid pressure input 36 of the dp sensor 34 via the first line segment 22. In fact, recall that the first and second line segments 22, 24, and the chamber 40, and the first fluid portion 62 within the first and second line segments 22, 24, and the chamber 40 are in fluid communication with the first fluid pressure input 36 of the dp sensor 34. As such the fluid pressure of the first fluid portion 62 within the first and second line segments 22, 24, and the chamber 40 is applied to the first fluid pressure input 36 of the dp sensor 34.

It is to be appreciated that with the ability of the first and second fluid control valves 44, 50 to be both operated to the respective open positions (e.g., see FIG. 4), the first fluid pressure input 36 of the dp sensor 34 and the chamber 40 can be placed at the pressure of the surrounding water (e.g., seawater). Subsequently, the first fluid control valve 44 can be operated to the closed position (e.g., see FIG. 5) which thus captures (e.g., traps) the specific pressure of the surrounding water/seawater at the first fluid pressure input 36 of the dp sensor and the chamber 40. Such captured (e.g., trapped), specific pressure of the surrounding water/seawater remains at the first fluid pressure input 36 of the dp sensor 34 and the chamber 40 with the first fluid control valve 44 remaining in the closed position (e.g., See FIGS. 5 and 6). The captured (e.g., trapped), specific pressure remains even if there is a change in pressure of the surrounding water (e.g., seawater). Such captured (e.g., trapped), specific pressure can be considered to be a reference pressure. It is to be appreciated that at any point further in time, with the second fluid control valve 50 remaining open or upon opening of the second control valve 50, the second fluid pressure input 38 of the dp sensor 34 is subjected to the then current pressure of the surrounding water (e.g., seawater at the location 14, see FIG. 1)). It is to be further appreciated that the dp sensor 34 (FIG. 2) can sense the presence of a difference of pressure at the first and second fluid pressure inputs 36, 38 of the dp sensor. Moreover, the dp sensor 34 can sense the amount of difference of pressure at the first and second fluid pressure inputs 36, 38 of the dp sensor. Difference of pressure can be indicative of change of depth underwater, such as may occur due to change of depth of seabed floor (e.g. seafloor subsidence). Such monitoring occurs over time (e.g., possibly a relatively long time period, such as a year). So, the dp sensor 34 is configured to repeatedly sense/determine a possible difference in the pressures present between the first fluid pressure input 36 and the second fluid pressure input 38 over the course of time. Moreover, the dp sensor 34 is configured to determine/sense the difference in the pressures present between the first fluid pressure input 36 and the second fluid pressure input 38 as an indication of possible pressure change of the water at the sub-surface water environment location. Such is via a determination/sensing that there is a difference in pressure between the first fluid pressure input 36 and the second fluid pressure input 38.

Figure 5:
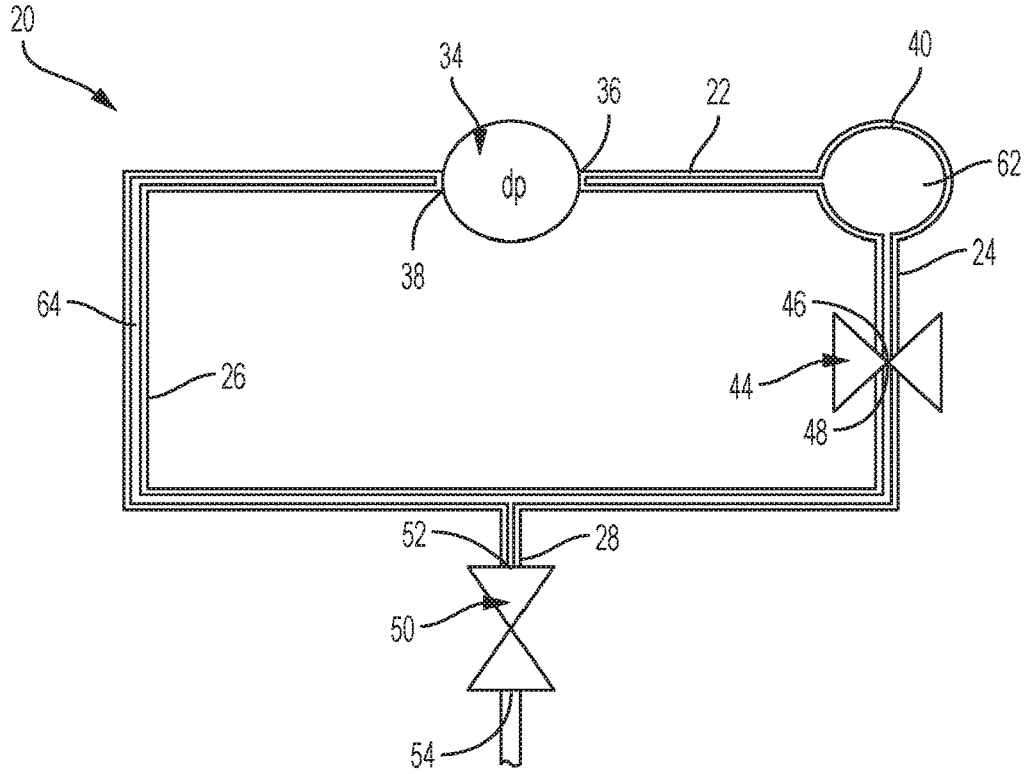
FIG. 5 is a schematic view similar to FIG. 2 showing at least a portion of the system, but with a rightmost valve, as viewed within the Figures, now closed off to isolate a portion of the system from the environment water.
Figure 6:
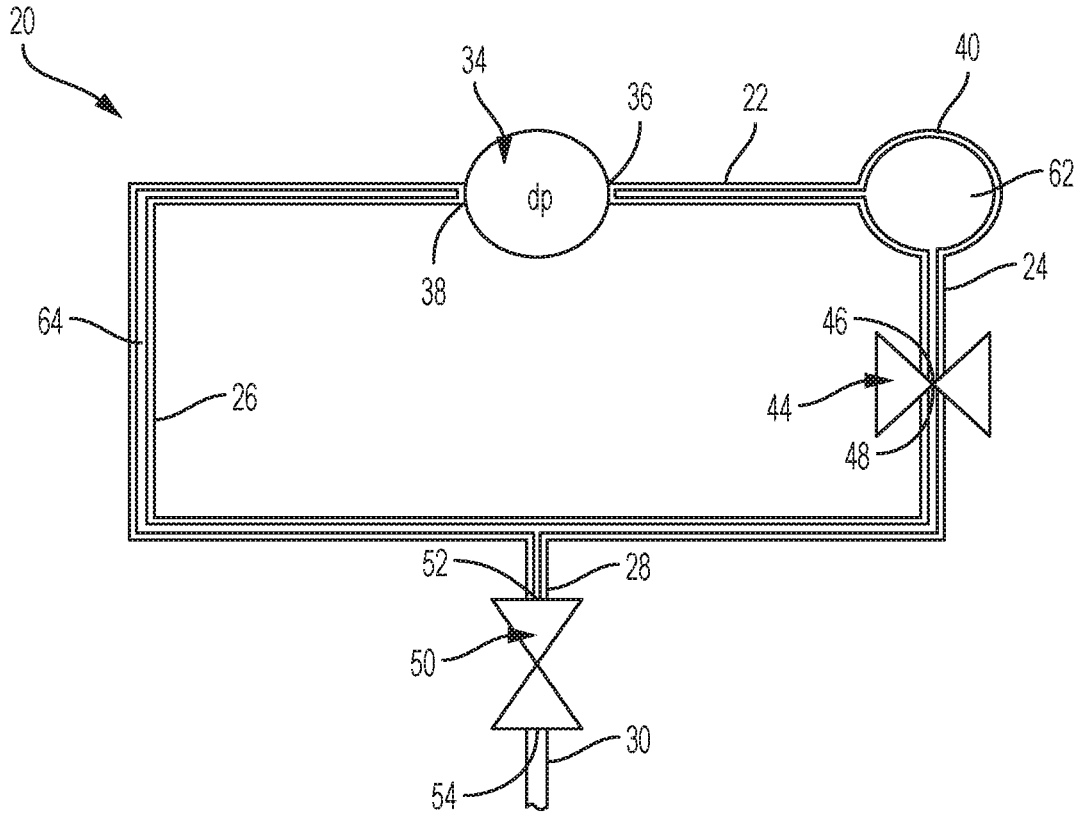
FIG. 6 is a schematic view similar to FIG. 2 showing at least a portion of the system, but with system operational to measure pressure and thus provide indication of any change of pressure.

To illustrate this point, FIG. 6 is provided. FIG. 6 is similar to FIG. 5, except that the pressure of the surrounding water (e.g., seawater at location 14 in FIG. 1) within FIG. 6 is different from the pressure of the surrounding water (e.g., seawater at location 14 in FIG. 1) within FIG. 5. So, the pressure of the second fluid portion 64 within the third line segment 26 in FIG. 6 is different from the pressure of the second fluid portion 64 within the third line segment 26 in FIG. 5. The pressure of the second fluid portion 64 within the third line segment 26 follows along or tracks with the pressure of the surrounding water (e.g., seawater) because the second fluid control valve 50 has remained open. However, the trapped pressure of the first fluid portion 62 (e.g., within the chamber 40 and at the first fluid pressure input 36 of the dp sensor 34) is isolated via the first fluid control valve 44 being closed. So, again the trapped pressure is a reference pressure. Difference of pressure of the surrounding water (e.g., seawater) relative to the trapped reference pressure can be indicative of change of depth underwater, such as may occur due to change of depth of seabed floor (e.g. seafloor subsidence).

The system can include a controller 70 (see FIG. 2, omitted from FIGS. 3-6) operatively connected 72 to the first fluid control valve 44, operatively connected 74 to the second fluid control valve 50 and operatively connected 76 to the dp sensor 34. As an initial matter concerning the controller 70, the controller is shown very generically (and highly schematically) because the controller can be of a variety of constructions/configurations and locations (e.g., on-site, remote, combination of on-site and remote as a bifurcation of location). The three respective operative connections 72-76 can be of a variety of constructions/configurations and locations, and can include structural integration into portions (e.g., first and second fluid control valves 44, 50 and/or the dp sensor 34) of the system 20 and/or hard-wired connection(s) and/or wireless transceiver connection(s) to location(s) away from portions (e.g., first and second fluid control valves 44, 50 and/or the dp sensor 34) of the system 20. So, the controller 70 may be located at the location of the dp sensor 34, first and second control valves 44, 50, etc. (i.e., at the subsea location 14 see FIG. 1), the controller 70 may be located remote from the location of the dp sensor 34, first and second valves 44, 50, etc. (i.e., away from the subsea location 14 see FIG. 1, such as above the water/seawater surface), or the controller 70 may be bifurcated to have portions both at the subsea location and remote from the subsea location. The controller 70 may include mechanical components, hard wired circuitry, one or more computing devices with operating programs, or a combination thereof. The controller 70 may include memory for storing data, programs and the like. It is to be appreciated that the term "controller", of the controller 70, is to be broadly interpreted.

As a possible example, the controller 70 may include a portion of a valve (e.g., the second control valve 50) that somehow reacts to water or significant water pressure. Such may be a portion of a valve (e.g., the second control valve 50) that is dissolved by the water/significant pressure to open. Also, the valve (e.g., one or both of the first and second control valves 44, 50) could be remotely operated or the valve (e.g., one or both of the first and second control valves 44, 50) could be triggered by a timer. Also, the controller 70 could provide electrical energy to one or both of the first and second control valves 44, 50 for operation thereof.

As mentioned, the dp sensor 34 can be operatively configured to sense or perceive the pressure at each of the first and second fluid pressure inputs 36, 38, and to sense/determine a difference or differential between the two sensed pressures. The dp sensor 34 can also be operatively configured to transmit pressure information (e.g., the difference or differential pressure information) to the controller 70. The controller 70 can be operatively configured to control operation of the dp sensor 34 (e.g., provide electrical energy, control sequencing/timing of sensor operation, perform diagnostics, etc.). The type, format, etc. of the communication between the controller 70 and the dp sensor 34 can be related to the construction/configuration of the operative connection there between (e.g., hard-wired and/or wireless transceiver).

As mentioned, the controller 70 can also be operatively configured to control each of the first and second fluid control valves 44, 50 (e.g., possibly provide electrical energy, control sequencing/timing of valve operation, perform diagnostics, etc.). Specifically, the controller can be operatively configured to cause operation of each of the first and second fluid control valves 44, 50 between the respective open and closed positions. The operation can be performed/accomplished via communication between the controller 70 and each of the first and second fluid control valves 44, 50. The type, format, etc. of the communication between the controller and each of the first and second fluid control valves can be related to the construction/configuration of the operative connection there between (e.g., hard-wired and/or wireless transceiver and/or physical integration).

It is to be appreciated that the FIGS. 3-6 show the same structural portions as FIG. 2, except the controller 70 and operative connections 72-76 are not shown within FIGS. 3-6. The controller 70 and operative connections 72-76 can be present, but simply omitted for simplification of viewing. It is to be appreciated that FIGS. 3-6 show the series of different positions, states, etc. for operation of the system 20.

After assembly of the example system 20 has been completed, an example method of preparation, installation/deployment and/or operation can be employed. In one example, the example system 20, and specifically the chamber 40, can be filled with a fluid, such as an inert gas (e.g. nitrogen), at a pressure slightly higher than the pressure at the planned installation site (e.g., at the seabed floor at the location 14). The fluid (e.g., inert gas) can be employed during the obtaining of the reference pressure (as will be described again following). Of course, a different gas (e.g., different from nitrogen) could be used. Also, as mentioned, a liquid (e.g., non-gas) could be used. Still further, it is to be appreciated that the above mentioned designated fluid can be omitted and the reference pressure can still be obtained. During this early, preliminary stage, the first fluid control valve 44 is open (see FIGS. 2 and 3). With the first control valve 44 open, fluid flow of whatever fluid(s) are present is permitted to flow through the first control valve. If there is any difference in pressure present between the two sides of the first control valve (i.e., pressure within the third line segment 26 vs. the pressure in the first and second line segments 22, 24 and the chamber 40), such difference is equalized/homogenized and thus becomes non-existent. Since the dp (differential pressure) sensor 34 is exposed to the same pressure (i.e., equalized/homogenized) on both sides, the dp sensor 34 perceives no net differential pressure. Also, whether with use of a designated fluid (e.g., nitrogen) or not, the second control valve 50 is placed into its closed position (e.g., see FIGS. 2 and 3). So, the first-third line segments 22-26 and the chamber 40 are sealed-off from the external atmosphere, at least for an initial time period. Such allows for transportation and installation to a subsea location (e.g., location 14 see FIG. 1).

Figure 3:
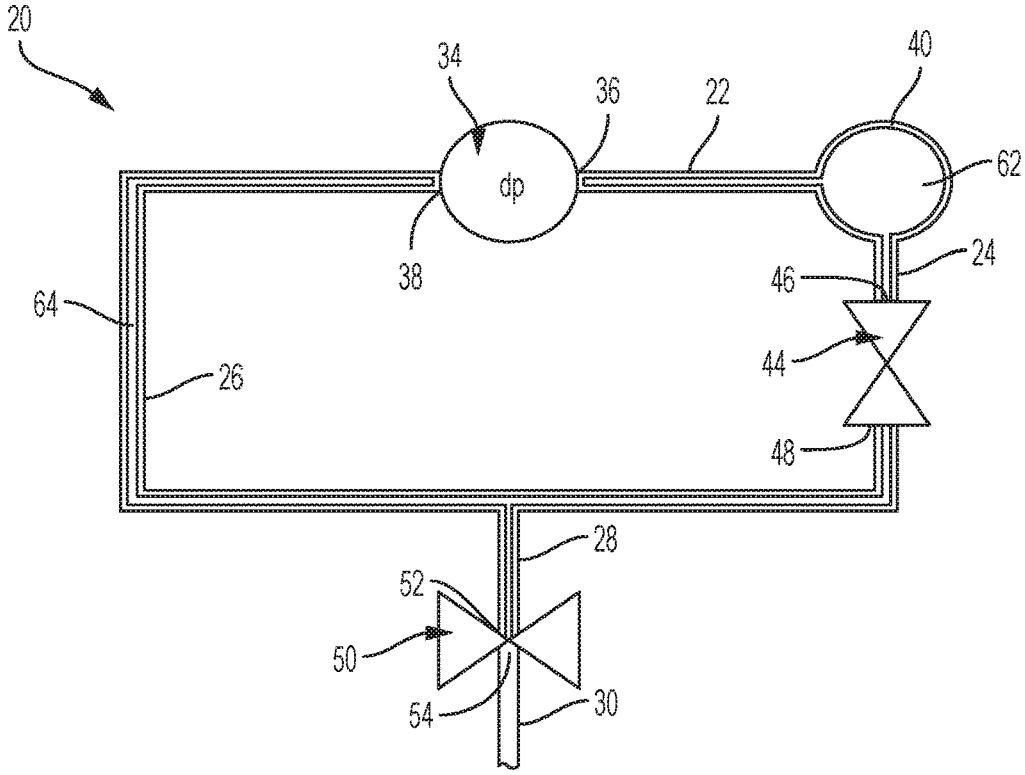
FIG. 3 is a schematic view similar to FIG. 2 showing at least a portion of the system, but shows the system during installment into water (e.g., seawater)

FIG. 3 shows the system during installation of the system 20 into water (e.g., sea water). In other words, during lowering to a desired position (e.g., at depth on the seabed). Note that the first control valve 44 can be in the open position. Again, the purpose is to equalize the pressures on the two sides of the dp sensor 34. The second control valve 50, which is located along the Tee to the outlet/inlet port 30, is closed. The closed second control valve 50 prevents entrance or escape of fluid from the system 20 at this time. So, the equalized/homogenized pressure within the first-third line segments 22-26 and the chamber 40 is not disturbed. However, during installation the port 30 can fill/begin to fill with water.

Figure 4:
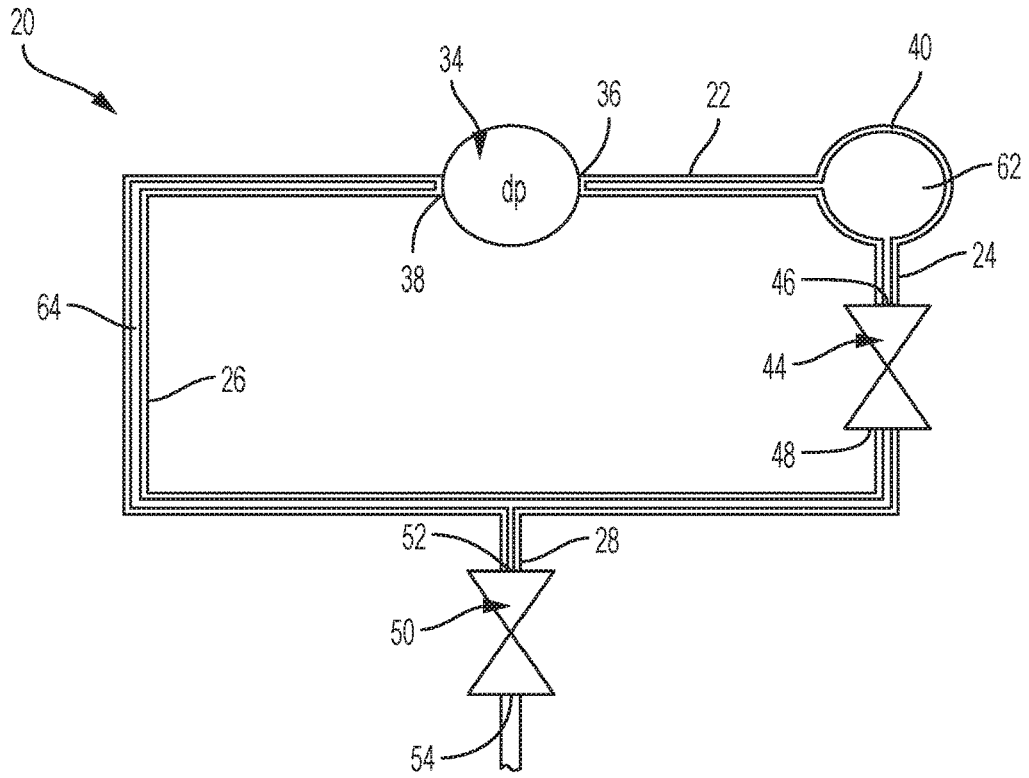
FIG. 4 is a schematic view similar to FIG. 2 showing at least a portion of the system, but shows the system once placed at a desired location (e.g., at a seabed floor) and with a leftmost, as viewed within the Figures, valve opened.

FIG. 4 shows the system 20 once at the desired position (e.g., at depth on the seabed). Once in position on the seabed (e.g., location 14 see FIG. 1), the second control valve 50 (i.e., located along the Tee to the outlet/inlet port) is be opened. This opening of the second control valve 50 can be performed in a variety of ways and is generically presented to be via the controller 70. However, recall that the controller 70 can be of various constructions/configurations and can be located at-site, remotely-located, or a combination of both, and can have various types/manners of operation. So, the aspect of control via the controller 70, to operate the second control valve 50 to the open position is to be broadly interpreted and can be via a variety of mechanisms, devices, etc. and via a variety of methodologies. For example, the second control valve 50 could have a portion, which thus is at part of the controller 70, that is dissolved by, or otherwise reacts with, the water during a prescribed time period (e.g., with a few hours or days after placement on the seabed floor), the second control valve 50 could be remotely operated (e.g., via wired wireless communication from a remote location) or the second control valve 50 could be triggered to open by a timer within the controller 70. In one example, if a designated fluid, such as a gas, is present within the line segments 22-26/chamber 40, the designated fluid (e.g., gas) may then be fully or partially ejected from the system 20 (e.g., line segments 22-26/chamber 40) and water may enter the system. In particular, such may occur if the system 20 is oriented so that the port 30/the Tee (e.g., at 28) is directed upward or laterally. In the configuration where the port 30 is directed downwards, some or all of the designated fluid (e.g., gas) may remain within the system 20. In particular, some/all of the designated fluid (e.g., gas) may remain within the chamber 40. The chamber 40 may remain fully or partially filled with the designated fluid (e.g., gas). For all cases, of the designated fluid (e.g., gas) being present, fully or partially being ejected and/or the designated fluid (e.g., gas) fully or partially remaining, there is an equalizing to surrounding pressure of the water at the seabed floor. In other words, all of the fluids (e.g., the water at the seabed floor, water that may enter the system 20, designated fluid that may be a gas) all proceed to the same pressure. That pressure is the pressure of the water at the seabed floor (e.g., location 14 see FIG. 1). This can be referred to as a pressure sampling process.

As a next step, which is shown in FIG. 5, the first control valve 44, which is the valve within the loop (i.e., the right-most valve in the Figures), can be actuated from an open (i.e., open to allow water/fluid movement and pressure equalization) position/condition to a closed position/condition. The control to cause the first control valve 44 to operate and change from the open to the closed condition can be provided by the controller 70. However, recall that the controller 70 can be of a variety of constructions/configurations and can be at a variety of locations. As some examples of accomplishing the control/operation of the first control valve 44 include that the first control valve could be remotely operated (e.g., via wired wireless communication from a remote location) or the first control valve could be triggered to operate by a timer (e.g., a prescribed time period after the second valve is actuated) or even a portion of the first control valve reacts (e.g., dissolves) to the water to cause the closure of the first control valve but at a rate slower than a water reaction rate at the second control valve. So, the aspect of control via the controller 70, to operate the first control valve 44 to the closed position is to be broadly interpreted and can be via a variety of mechanisms, devices, etc. and via a variety of methodologies.

The closure of the first control valve, which is interposed between the third line segment 26 and the first and second line segments 22, 24 and the chamber 40, thus separates the fluid (e.g., possibly including gas) in the first and second line segment and the chamber from the remainder of the system 20, such as the third line segment 26, that is/are exposed to water (e.g., sea water). So, now the first control valve 44 (e.g., the valve in the loop) is closed off and the fluid portion (e.g., possibly some gas) 62 in the chamber 40, line segments 22, 24 and the first pressure input 36 of the dp sensor 34 is closed off from further integration with the external water (e.g., sea water at the seabed floor). Moreover, the separation via the closing of the first control valve 44, closes off or isolates the fluid pressure that is within the chamber 40, line segments 22, 24 and the first pressure input 36 of the dp sensor 34. With the first control valve 44 now closed off, the pressure sampling process has been completed. Also, this can be referred to as sealing of a reference/sealing of a reference pressure. So, the fluid portion (e.g., possibly including a gas) 62 within the chamber 40, line segments 22, 24 and the first pressure input 36 of the dp sensor 34 is entrapped/sealed therein and can be referred to as a reference fluid with a reference pressure.

FIG. 6 shows the system 20 operational to measure pressure and thus provide indication of any change of pressure. Specifically, the system 20 can operate to measure change in surrounding pressure of the water at the seabed floor. Changes to the location (e.g., depth under water caused by subsidence or elevation of the seabed) of the system 20 can appear as pressure changes to the open port 30 located at the Tee. However, due to the first control valve 44 (i.e., the right-most valve in the Figures) being closed off this pressure will not propagate to the entrapped/sealed reference fluid (e.g., possibly including gas) within the chamber 40, line segments 22, 24 and the first pressure input 36 of the dp sensor 34. Recall that the entrapped/sealed reference fluid (e.g., possibly including gas) within the first/second tubing segments is pressurized/retained to be at the initially captured/trapped pressure.

Although the accuracy of determining changes in the location (e.g., change of depth under water caused by subsidence or elevation of the seabed) can vary, in one example the system 20 may be able to provide sub-centimeter (i.e., sub-cm) long term resolution of the change. In one example, the system 20 is able to discriminate motion of less than one (1) cm/year. A one (1) meter of change in water depth corresponds to about a 0.1 bar change of pressure. As such, a one (1) cm change in depth equates to a one (1) mbar change in pressure. As such, the example system 20 can discern a minimum of a one (1) mbar change in pressure. Of course, other/different parameters and abilities for different examples of the system can be provided.

The sensed/determined change in pressure can be stored at the system 20 (e.g., at the controller 70 or another portion) conveyed to a remoted location (e.g., a location above the sea, etc.). The sensed/determined change in pressure can be utilized as desired (e.g., to control pressure, flow, etc., of fluids, such as natural gas and/or oil that is extracted, moved, stored, or the like subsurface and potentially at the location of the system 20 at the subsea floor.

As an option, accuracy of the system 20 can be improved if one also account for temperature changes, via temperature monitoring, to the entrapped/sealed reference fluid (e.g., possibly including gas). Such may be referred to as temperature compensation. Such temperature compensation may be accomplished via addition of suitable structures/configurations. Such suitable structures/configurations may be part of the controller 70 or other portion(s) of the system 20. The temperature compensation may be performed at the dp sensor 34 of the system 20. Thus, the sensed/determined change in pressure can be conveyed as a temperature-corrected value. Also, the monitored temperature and/or temperature compensation could be conveyed, such as via the controller 70, to a remote location, such as above the water surface, for use thereat.

It is to be appreciated that plural systems 20, at plural subsea floor locations, can be present within an overall system, network or the like. Such plural systems 20 can provide respective pressure change (and thus depth change) indications.

As a general review the following example system 20 can be provided such that the system monitors pressure of water at a sub-surface water environment location 14 that has elevated water pressure. The system 20 includes a chamber 40 enclosing a fluid at pressure located therein. The system 20 includes a dp (differential pressure) sensor 34 including a first fluid pressure input 36 in fluid communication with the chamber 40 and a second fluid pressure input 38. The system 20 includes a fluid line segment 26 in fluid communication with the second fluid pressure input 38 of the dp sensor. The system 20 includes a first operable fluid control valve 44 including a first valve connection 46 in fluid communication with the chamber 40 and a second valve connection 48 in fluid communication with the fluid line segment 26. The first fluid control valve 44 is configured to have a first valve position in which the chamber 40 is in fluid communication with the fluid line segment 26 through the first fluid control valve 44 and is configured to have a second valve position in which the chamber 40 is blocked from fluid communication with the fluid line segment 26. The system 20 includes a second operable fluid control valve 50 including a first valve connection 52 in fluid communication with the fluid line segment 26 and a second valve connection 54 in fluid communication with the water at the sub-surface water environment location (e.g., at 14). The second fluid control valve 50 is configured to have a first valve position in which the fluid line segment 26 is blocked from fluid communication with the water at the sub-surface water environment location (e.g., at 14) and is configured to have a second valve position in which the fluid line segment 26 is in fluid communication with the sub-surface water environment location (e.g., at 14) through the second fluid control valve 50.

Several example benefits of the presented system 20 can be possible. One example benefits of the presented system 20 is that the dp sensor 34 can be preconditioned to operation since it is subjected to pressure near the installation time in the period from leaving the factory until deployment. It can therefore require a significantly shorter time to become stable. Another example benefit of the presented system 20 is that one can use a differential pressure sensor with a range scaled according to the expected subsidence rate and installation lifetime. This typically means that the dp sensor can have the potential to have approximately one thousand (1000) times the resolution of an absolute sensor which ought to provide a correspondingly improved resolution also in accuracy when measuring movement. So there is improved resolution for monitoring small changes from a sampled pressure (e.g., from subsea movement such as subsidence).

One example aspect can be: improved accuracy made possible by using a differential pressure (dp) sensor over an absolute pressure sensor.

Another example aspect can be: pre-conditioning of the dp sensor to reduce the period of asymptotic drift caused by the compressibility of various elements in the dp sensor and its housing.

A further example aspect can be: no need for overpressure protection due to the dp sensor is symmetrically loaded until sampling has been completed.

One alternative approach can be to pre-charge a sealed vessel to the reference pressure. This requires accurate knowledge about the base pressure to be measured at, and would require an application-site specific configuration of a product. Another approach could be to charge a large volume with fluid (e.g., gas) and let the ambient pressure compress it via a tubing system or via the use of a bladder. Such could add additional size.

As yet another example, the pressure can be sampled merely by water, and thus not needing a specifically entrapped/sealed fluid (e.g., the gas). Such an example configuration will only require a single initially open valve that upon closure will entrap/seal the sampling volume of water. Such an example system may have a lesser discerning performance ability, but has a benefit of being of simple design. As still a further example, the chamber 40 could be omitted so that just line segments are employed.

It is to be appreciated that just one area of application could be at/near a seafloor environment. Of course, it is to be appreciated that non-seabed usability options are contemplated. Some examples of such non-seabed use options include at a location suspended in water (e.g., a riser) or inside of a well extending through water to subsea floor.

There are several further aspects to be appreciated from the subject matter disclosed herein. The following are some further example aspects.

In accordance with at least one aspect, the subject matter disclosed herein provides a system to measure small pressure changes at nearly constant elevated pressures.

In accordance with at least one aspect, the subject matter disclosed herein provides an increased capability to monitor small changes in pressure at elevated pressures. The configuration permits not including an overload protection system as it is always pressure balanced within the tolerable pressure range of relevant dp-pressure sensors and technologies. The system may provide sub-cm long term resolution for subsea subsidence.

In accordance with at least one aspect, the subject matter disclosed herein provides increased capability to monitor small changes in pressure at elevated pressures. In accordance with at least one aspect, a configuration permits not including an overload protection system as the configuration is always pressure balanced within the tolerable pressure range of relevant dp-pressure sensors and technologies. In accordance with at least one aspect, a system can provide sub-cm long term resolution for subsea seabed floor movement (e.g., subsidence).

In accordance with at least one aspect, the subject matter disclosed herein provides a system that permits sampling the ambient pressure in such a fashion that the system has been preconditioned for the base pressure, using a smaller range pressure sensor making drift less noticeable while enabling the system to be compact. Furthermore, due to the gas release mechanism, the system does not need to be accurately charged prior to deployment and can be manufactured without application-site specific tuning.

The subject matter disclosed herein has been described with reference to the example embodiments described above. Modifications and alterations will occur to others upon a reading and understanding of this specification. Example embodiments incorporating one or more aspects of the subject matter disclosed herein are intended to include all such modifications and alterations insofar as they come within the scope of the appended claims.

What is claimed:

1. A system for monitoring pressure of water at a sub-surface water environment location, the system comprising:

a chamber configured to enclose a fluid at a pressure;

a differential pressure sensor including a first fluid pressure input, in fluid communication with the chamber, and a second fluid pressure input;

a fluid line in fluid communication with the second fluid pressure input of the differential pressure sensor;

a first operable fluid control valve including a first fluid control valve connection in fluid communication with the chamber and a second fluid control valve connection in fluid communication with the fluid line, the first operable fluid control valve having a first valve position in which the chamber is in fluid communication with the fluid line through the first fluid control valve and having a second valve position in which the chamber is blocked from fluid communication with the fluid line; and a second operable fluid control valve including a third fluid control valve connection in fluid communication with the fluid line and a fourth fluid control valve connection configured for fluid communication with water at a sub-surface water environment location, the fourth fluid control valve having a first valve position in which the fluid line is blocked from fluid communication with water at a sub-surface water environment location and having a second valve position in which the fluid line is configured for fluid communication with the water at the sub-surface water environment location through the fourth fluid control valve;

wherein the first fluid pressure input and the second fluid pressure input are configured to have a common pressure when the first operable fluid control valve is in the first valve position and the second operable fluid control valve is in the second valve position.

2. The system of claim 1, wherein the chamber and the first operable fluid control valve are configured and operable to capture a reference pressure for fluid enclosed within the chamber, such that the reference pressure is present at the first fluid pressure input of the differential pressure sensor.

3. The system of claim 2, wherein, when the first operable fluid control valve is in the second valve position, the first operable fluid control valve is configured to capture a reference pressure for fluid enclosed within the chamber.

4. The system of claim 2, wherein the chamber and the first operable fluid control valve are configured and operable to retain the reference pressure for fluid enclosed within the chamber independent of any change in a pressure of water at a sub-surface water environment location.

5. The system of claim 1, wherein the second operable fluid control valve and the fluid line are configured and operable to permit a pressure of water at a sub-surface water environment location to be present at the second fluid pressure input of the differential pressure sensor.

6. The system of claim 5, wherein, when the second operable fluid control valve is in the second valve position, the second operable fluid control valve is configured to permit a pressure of water at a sub-surface water environment location to be present at the second fluid pressure input of the differential pressure sensor.

7. The system of claim 1, wherein the second fluid control valve and the fluid line are configured and operable to permit any change in a pressure of water at a sub-surface water environment location to be present at the second fluid pressure input of the differential pressure sensor independent of a pressure of fluid enclosed within the chamber.

8. The system of claim 1, wherein the first operable fluid control valve and the second operable fluid control valve are configured and operable to permit a pressure of water at a sub-surface water environment location to be present at both the first and second fluid pressure inputs of the differential pressure sensor during capture of a reference pressure for fluid enclosed within the chamber.

9. The system of claim 1, wherein the differential pressure sensor is configured to sense a difference in pressures present between the first fluid pressure input and the second fluid pressure input.

10. The system of claim 9, wherein the differential pressure sensor is configured to sense the difference in the pressures present between the first fluid pressure input and the second fluid pressure input at a different time as an indication of a pressure change of water at a sub-surface water environment location.

11. The system of claim 9, further comprising a controller remotely located from the differential pressure sensor, and wherein the differential pressure sensor is configured to transmit pressure information to the controller.

12. The system of claim 9, further comprising a controller operatively connected to the first operable fluid control valve, the controller being configured to control the first operable fluid control valve to move from the first valve position, in which the chamber is in fluid communication with the fluid line through the first operable fluid control valve, to the second valve position, in which the chamber is blocked from fluid communication with the fluid line, once the system is at a sub-surface water environment location, and the controller being configured to capture a reference pressure for fluid enclosed within the chamber, such that the reference pressure is present at the first fluid pressure input of the differential pressure sensor.

13. The system of claim 9, further comprising a controller operatively connected to the second operable fluid control valve, the controller being configured to control the second operable fluid control valve to proceed from the third valve position, in which the fluid line is blocked from fluid communication with water at a sub-surface water environment location, to the fourth valve position, in which the fluid line is in fluid communication with water at a sub-surface water environment location through the second fluid control valve, once the system is at a sub-surface water environment location, and the controller being configured to permit a pressure of water at a sub-surface water environment location to be present at the second fluid pressure input of the differential pressure sensor.

14. A method for monitoring pressure of water at a sub-surface water environment location that has elevated water pressure using a system, the method comprising:

providing a chamber enclosing a fluid located therein;

providing a differential pressure sensor including a first fluid pressure input in fluid communication with the chamber and a second fluid pressure input;

providing a fluid line in fluid communication with the second fluid pressure input of the differential pressure sensor;

providing a first operable fluid control valve including a first valve connection in fluid communication with the chamber and a second valve connection in fluid communication with the fluid line, wherein the first fluid control valve has a first valve position in which the chamber is in fluid communication with the fluid line through the first fluid control valve and a second valve position in which the chamber is blocked from fluid communication with the fluid line; and providing a second operable fluid control valve including a first valve connection in fluid communication with the fluid line and a second valve connection in fluid communication with the water at the sub-surface water environment location, wherein the second fluid control valve has a first valve position in which the fluid line is blocked from fluid communication with the water at the sub-surface water environment location and a second valve position in which the fluid line is in fluid communication with the water at the sub-surface water environment location through the second fluid control valve;

placing the second fluid control valve in the valve position to cause the fluid line to be blocked from fluid communication with the water at the sub-surface water environment location during placement of the system at the sub-surface water environment location;

placing the first fluid control valve in the valve position to cause the chamber to be in fluid communication with the fluid line through the first fluid control valve and placing the second fluid control valve in the valve position to cause the fluid line to be in fluid communication with the water at the sub-surface water environment location through the second fluid control valve during sampling of pressure at the sub-surface water environment location to obtain a reference pressure, receiving the reference pressure at the first pressure input of the differential pressure sensor via the first fluid control valve in the first valve position;

receiving the reference pressure at the second pressure input of the differential pressure sensor via the second fluid control valve in the second valve position;

placing the first fluid control valve in the respective second valve position to cause the chamber to be blocked from fluid communication with the fluid line to capture the reference pressure in the chamber that is in fluid communication with the first fluid pressure input of the differential pressure sensor; and sensing, by the differential pressure sensor, a difference between the reference pressure in the chamber provided to the first fluid pressure input of the differential pressure sensor and a pressure of water provided to the second fluid pressure input of the differential pressure sensor via the fluid line and the second fluid control valve being in the respective second valve position to cause the fluid line to be in fluid communication with the water at the sub-surface water environment location through the second fluid control valve.

15. The method of claim 14, wherein a pressure of water at a sub-surface water environment location changes over time to differ from the reference pressure and the method includes allowing fluid flow through the second fluid control valve, through the fluid line, and to the second fluid pressure input of the differential pressure sensor to permit any change in the pressure of the water at the sub-surface water environment location to be present at the second fluid pressure input of the differential pressure sensor independent of the reference pressure.

16. The method of claim 14, wherein fluid located within the chamber at least initially includes at least some gaseous fluid.

17. The method of claim 14, further comprising determining a difference in the pressures present between the first fluid pressure input and the second fluid pressure input over a period of time.

18. The method as set forth in claim 14, wherein a controller remotely located from the differential pressure sensor and operatively connected to the differential pressure sensor receives pressure information from the differential pressure sensor.

19. The method of claim 18, wherein a controller operatively connected to the first fluid control valve and the controller to and the second fluid control valve controls the first and second fluid control valves.

* * * * *